US005177886A

United States Patent [19]

Klett

[11] Patent Number: 5,177,886

[45] Date of Patent: Jan. 12, 1993

[54] TOOTH WITH CLEARANCES IN SOCKET

[75] Inventor: Gene R. Klett, Washington, Ill.

[73] Assignee: Caterpillar Inc., Peoria, Ill.

[21] Appl. No.: 851,719

[22] Filed: Mar. 16, 1992

[51] Int. Cl.[5] ..... E02F 9/28

[52] U.S. Cl. ..... 37/141 T; 37/141 R; 37/142 R

[58] Field of Search ..... 37/141 T, 142 R, 142 A, 37/118 R

[56] References Cited

U.S. PATENT DOCUMENTS

| | | | |
|---|---|---|---|
| 2,915,290 | 12/1959 | Petersen . | |
| 3,079,710 | 3/1963 | Larsen et al. . | |
| 3,774,324 | 11/1973 | Lafond . | |
| 4,013,130 | 3/1977 | Wirt et al. . | |
| 4,319,415 | 3/1982 | Mayerböck et al. | 37/141 T X |
| 4,335,532 | 6/1982 | Hahn et al. . | |
| 4,404,760 | 9/1983 | Hahn et al. . | |
| 4,577,423 | 3/1986 | Hahn | 37/142 R |
| 4,965,945 | 10/1990 | Emrich | 37/142 R |
| 5,068,986 | 12/1991 | Jones | 37/142 R |

*Primary Examiner*—Randolph A. Reese
*Assistant Examiner*—J. Russell McBee
*Attorney, Agent, or Firm*—J. W. Burrows

[57] ABSTRACT

Tip and adapter assemblies are normally utilized to provide an arrangement in which the tip can be readily removed from the adapter. It is normally advantageous to have a simple construction that allows the tip to be mounted on the adapter with the least amount of effort and likewise to have the ability to remove the tip from the adapter in like manner. In the subject arrangement, the tooth defines a socket which is adapted for mating contact with a nose portion of an adapter. The socket has a generally circular load transferring surface located adjacent an opening thereof. A plurality of clearance slots are provided angularly spaced around the circumference of the generally circular load transferring surface. A generally rectangular load transferring pocket is located in the socket adjacent a bottom surface thereof and has clearance reliefs defined thereon. A relief cavity is located in the socket between the generally circular bond transferring surface and the generally rectangular load transferring pocket. The relief cavity in conjunction with the clearance slots and the clearance reliefs enable the tooth to be mounted on the adapter that has four raised helical threads disposed thereon without having to rotate the tooth during assembly or disassembly thereof.

12 Claims, 5 Drawing Sheets

TOOTH WITH CLEARANCES IN SOCKET

TECHNICAL FIELD

This invention relates generally to a tooth and more particularly to an interface of a tooth with an adapter.

BACKGROUND ART

In the past, many designs have been developed for mounting a tooth onto an adapter. In most applications, the tooth contains a wedge-shaped socket at the rear of the tooth, and the adapter has a nose with a corresponding shape to receive the tooth. Teeth and adapters of this type are illustrated in U.S. Pat. No. 2,915,290, issued Dec. 1, 1959 to G. Petersen; U.S. Pat. No. 3,079,710, issued Mar. 5, 1963 to P. Larsen et al.; U.S. Pat. No. 3,774,324, issued Nov. 27, 1973 to G. Lafond; and U.S. Pat. No. 4,013,130, issued Mar. 22, 1977 to L. Wirt et al.

U.S. Pat. No. 4,335,532, issued Jun. 22, 1982, to F. Hahn, et al., and U.S. Pat. No. 4,404,760, issued Sep. 20, 1983 to F. Hahn, et al. each teach another approach to connecting the tooth to the adapter. Each of the above-noted patents teach having raised threads on the adapter nose while having corresponding mating grooves in the socket of the tooth. The concept illustrated in U.S. Pat. No. 4,335,532 has been commercially used and requires that the tooth be rotated as it is being assembled onto the adapter. The rotation of the tooth during assembly is necessary since the adapter nose has four raised helical threads disposed thereon and the socket of the tooth has helical grooves to receive, in load bearing contact, the raised helical threads on the adapter. Since the tooth has to be rotated during assembly, it necessarily has to be rotated in the reverse direction during disassembly. The need to rotate the tooth during disassembly can oftentimes create a problem since, during operation, fine dirt particles become packed in the socket of the tooth between the tooth and the adapter. When the fine dirt particles become packed between the raised helical threads and the corresponding helical grooves, it becomes more difficult to remove the tooth from the adapter. This difficulty is generally attributed to the need to rotate the tooth relative to the adapter.

It is desirable to provide a tooth arrangement that permits the tooth to be assembled and disassembled onto an adapter having raised helical threads without having to rotate the tooth during assembly and/or disassembly and to eliminate corresponding load bearing grooves in the tooth.

The present invention is directed to overcoming one or more of the problems as set forth above.

DISCLOSURE OF THE INVENTION

In one aspect of the present invention, a tooth is provided and adapted for connection to an adapter having a nose portion and four raised helical threads disposed on the nose portion in angularly spaced apart relation. Each thread of the four raised helical threads extends from a forward end of the nose portion rearwardly to a rearward end thereof. The tooth has a forward end portion operative to engage the ground and a rearward end portion operative to be releasably connected to the adapter. The rearward end portion defines a socket therein operative, when assembled, to receives the nose portion of the adapter. The rearward end portion also has in general longitudinal alignment, a generally rectangular load transferring pocket located in the socket adjacent the bottom of the socket, a generally circular load transferring surface located in the socket adjacent the opening of the socket and a relief cavity located in the socket between the generally rectangular load transferring pocket and the generally circular load transferring surface. Each side of the rectangular load transferring pocket has a clearance relief defined thereon and the circular load transferring surface has four clearance slots defined thereon circumferentially spaced from one another. The clearance reliefs, the relief cavity, and the clearance slots are operative, when assembling the tooth onto the adapter to provide clearance for the four raised helical threads on the adapter.

In another aspect of the present invention, a tooth is provided and adapted for connection, without angular rotation during assembly, to an adapter having a nose portion and four raised helical threads disposed thereon in angularly spaced apart relation. Each thread of the four raised helical threads extends from a forward end of the nose portion rearwardly to a rearward end thereof. The tooth has a forward end portion operative to engage the ground and a rearward end portion operative to be releasably connected to the adapter. The rearward end portion defines a socket therein operative, when assembled, to receive the nose portion of the adapter. The rearward end portion has in general longitudinal alignment, a generally rectangular load transferring pocket located in the socket adjacent the bottom of the socket and a generally circular load transferring surface located in the socket adjacent the opening thereof. Clearances are defined on the generally rectangular load transferring pocket and on the generally circular load transferring surface so that the tooth can be assembled straight onto the nose portion of the adapter free of angular rotation.

The present invention provides a tooth having a socket with clearances therein to permit the tooth to be assembled and disassembled straight onto an adapter having raised helical threads. The clearances in the socket overcomes any need to rotate the tooth during assembly and/or disassembly or to provide corresponding load bearing grooves in the tooth.

BEST MODE FOR CARRYING OUT THE INVENTION

Figure 1:
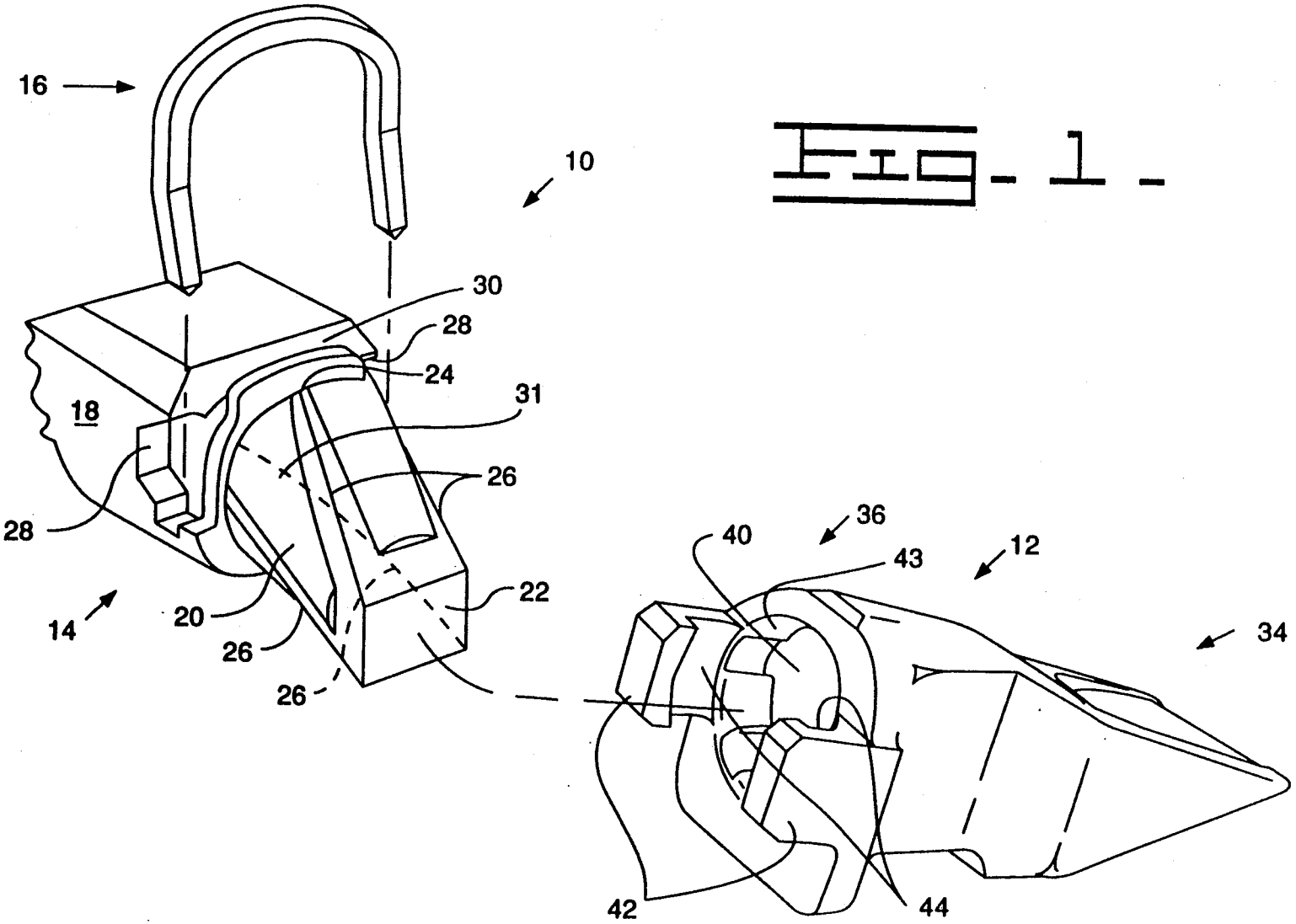
FIG. 1 is an isometric drawing representing a tooth and adapter assembly including an embodiment of the present invention.

Referring to the drawings, and more particularly to FIG. 1, a tooth and adapter assembly 10 is shown. The tooth and adapter assembly 10 includes a tooth 12, an adapter 14, and a locking mechanism, such as a U-shaped lock 16. The adapter 14 includes a body portion 18 and a nose portion 20. The nose portion 20 has a forward end 22 and a rearward end 24. Four raised helical threads 26 are disposed on the nose portion 20 angularly spaced from one another around the circumference thereof and extending from the forward end 22 towards the rearward end 24. Two recesses 28 are defined in the body portion 18 diametrically opposed from one another and located generally adjacent the rearward end 24 of the nose portion 20. A transverse slot 30 is defined in the body portion 18 generally adjacent the rearward end 24 of the nose portion 20 and interconnects the two recesses 28. A plurality of surfaces 31 define an interrupted surface of revolution on the nose portion 20 between the respective raised helical threads 26. Each of the plurality surfaces 31 extend from a location generally adjacent the rear end 24 forward to a location short of the forward end 22. The forward end 22 of the nose portion 20 has a generally rectangular shape that extends from the forward end 22 to the plurality of surfaces 31.

The tooth 12 has a forward end portion 34 operative to engage the ground for working material and a rearward end portion 36 operative to connect the tooth 12 to the nose portion 20 of the adapter 14. It should be recognized that the forward end portion 34 could be of various shapes without departing from the essence of the invention. A socket 40 is defined in the rearward end portion 36 of the tooth 12 and operative to receive the nose portion 20 of the adapter 14.

Locking tabs 42 extend from the rearward end portion 36 of the tooth 12 at a location generally adjacent an opening 43 of the socket 40. A slot 44 is defined in each of the locking tabs 42 and are respectively located adjacent the opening 43 of the socket 40. When the tooth 12 is assembled on the adapter 18, the respective locking tabs 42 are positioned in the respective recesses 28 and the U-shaped lock member 16 is disposed in the respective recesses 28, the transverse slot 30 and the respective slots 44 of the locking tabs 42 to secure the tooth 12 to the adapter 14.

Referring now more specifically to FIGS. 2-6, a more detailed description of the socket 40 is provided. The opening 43 of the socket 40 is defined in the rearward end portion 36 at the end thereof distal from the forward end portion 34. A bottom 48 of the pocket 40 is defined in the rearward end portion 36 spaced from the opening 43 in a direction towards the forward end portion 34. A groove 49 is defined in the rearward end portion 36 disposed circumferentially around the bottom 48 of the socket 40. A longitudinal plane 50 is centrally defined in the tooth 12 between the locking tabs 42 and extends through the forward end portion 34 and the rearward end portion 36.

Figure 2:
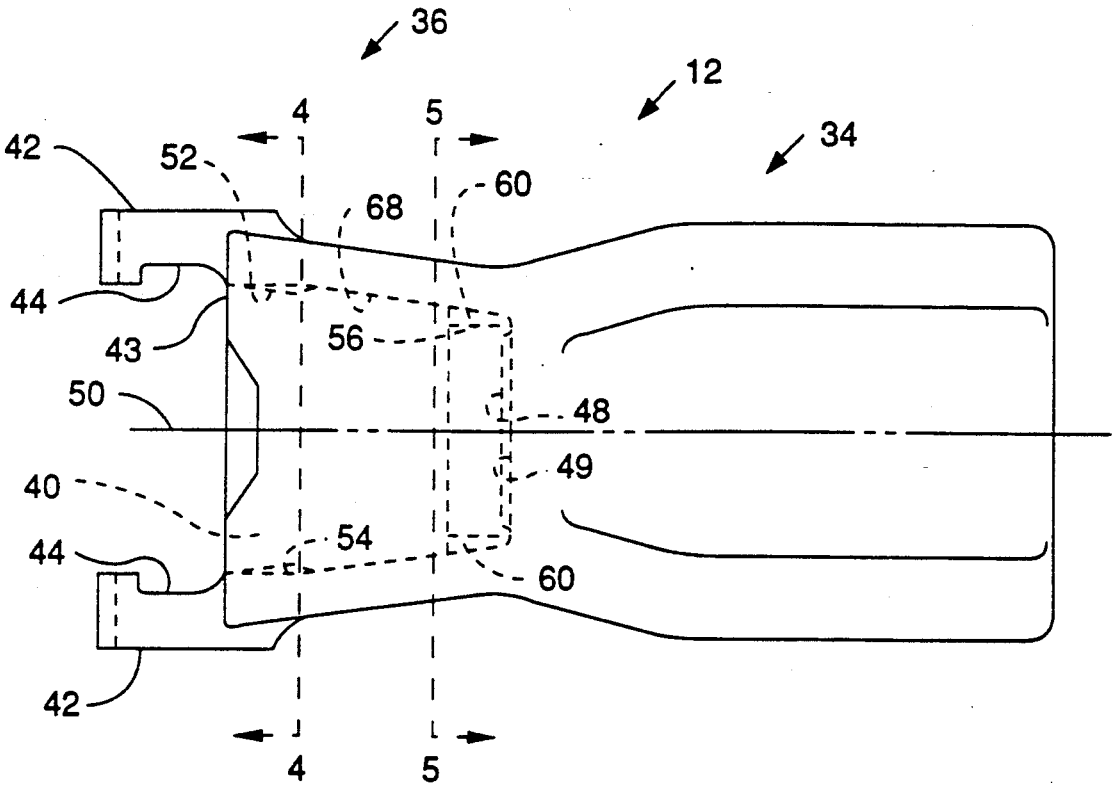
FIG. 2 is a top view of the tooth illustrated in FIG. 1.
Figure 3:
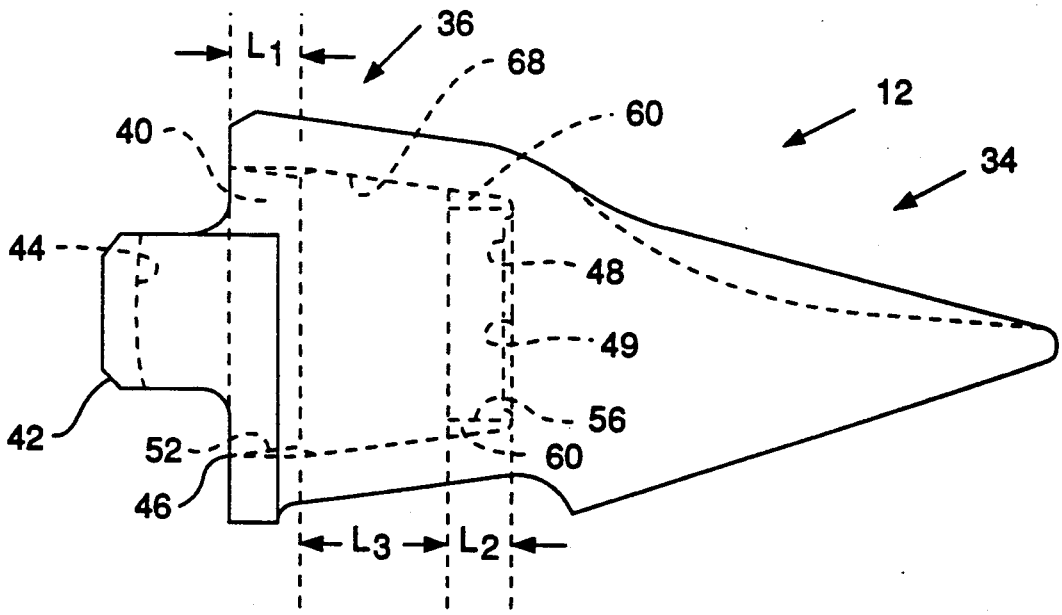
FIG. 3 is a side view of the tooth illustrated in FIG. 1.
Figure 4:
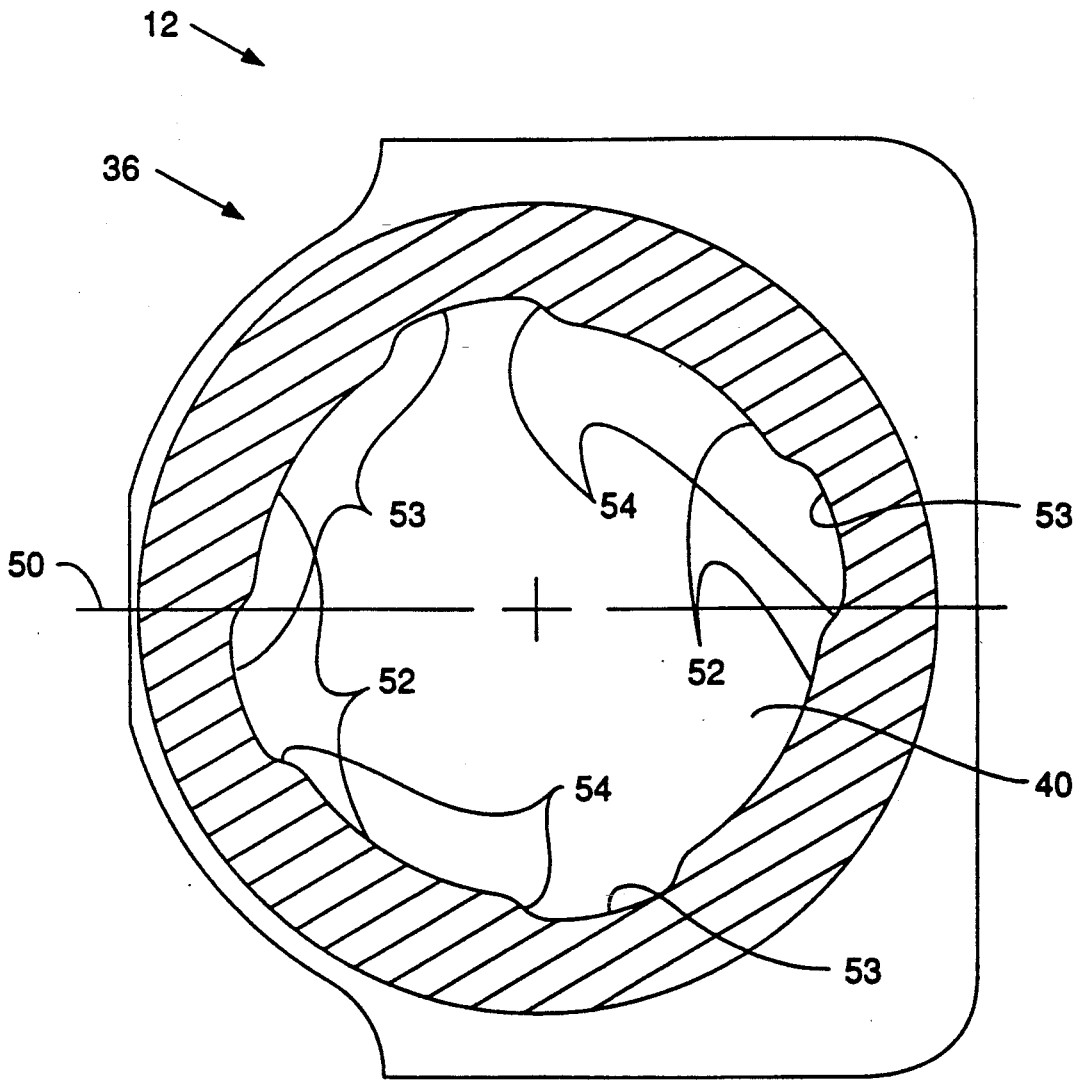
FIG. 4 is an enlarged cross-sectional view 4—4 taken from the tooth of FIG. 2.

As more clearly shown in FIG. 4, which is a cross-sectional view 4—4 taken from FIG. 2, a generally circular load transferring surface 52 is disposed on the rearward end portion 36 and located within the socket 40 generally adjacent the opening 43 thereof. The generally circular load bearing surface 52 has a predetermined dimensional length $L_1$ (FIG. 3) taken parallel to the longitudinal plane 50. A plurality of clearance slot surfaces 53 are circumferentially spaced form one another around the generally circular load transferring surface 52. The plurality of clearance slot surfaces 53 defines four clearance slots 54 in the rearward end portion 36. The four clearance slots 54 interrupt the generally circular load transferring surface 52. When the socket 40 of tooth 12 is mated with the nose portion 20 of the adapter 14, there is no contact between the clearance slot surfaces 53 and the raised helical threads 26 of the adapter 14.

Figure 5:
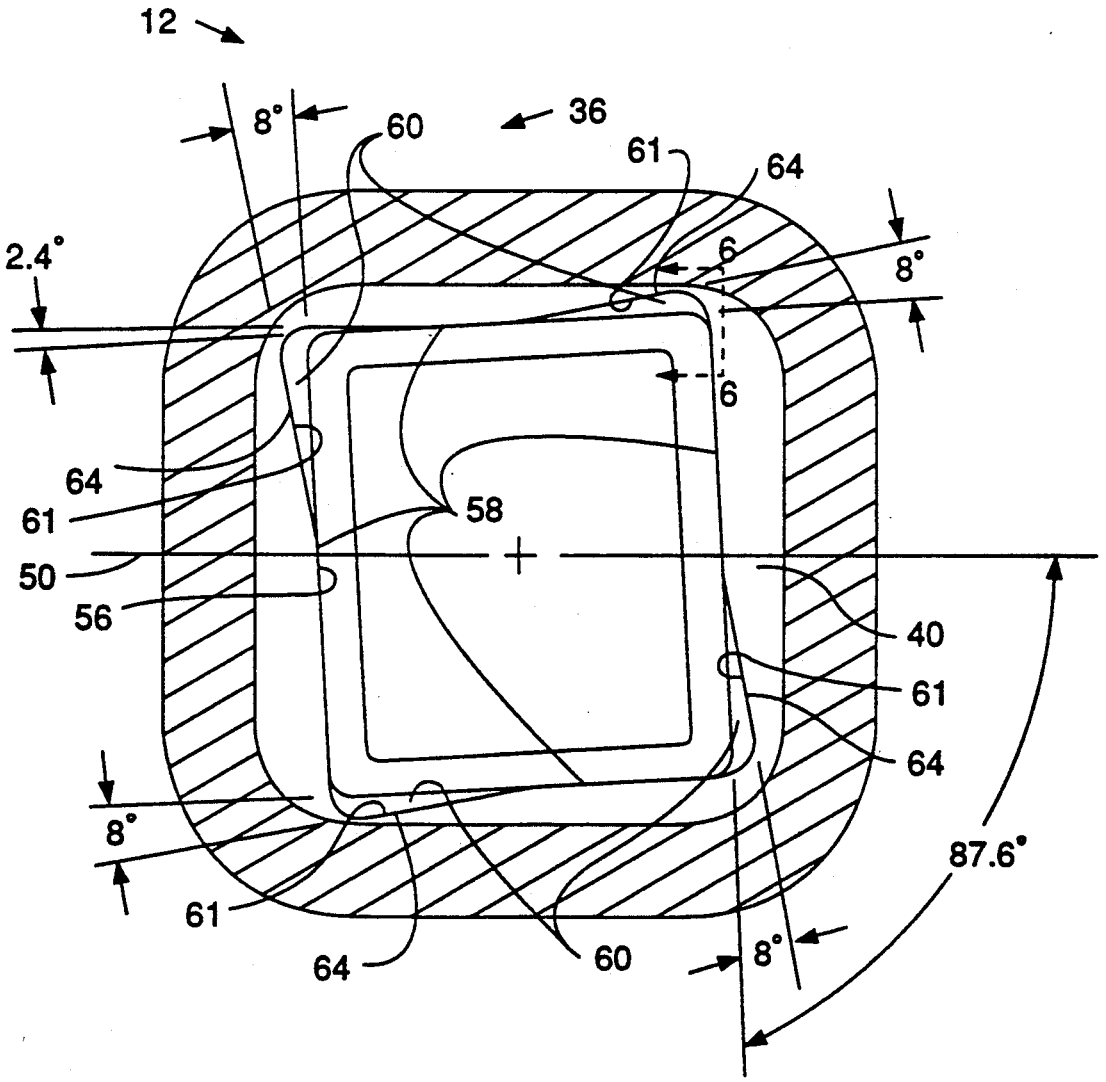
FIG. 5 is an enlarged cross-sectional view 5—5 taken from the tooth of FIG. 2.

As more clearly shown in FIG. 5, which is a cross-sectional view 5—5 taken from FIG. 2, a generally rectangular load transferring pocket 56 is disposed on the rearward end portion 36 and located within the socket 40 generally adjacent the bottom 48 thereof. The generally rectangular load transferring pocket 56 has a plurality of side surfaces 58. Each of the side surfaces 58 has a clearance relief 60 defined thereon and has a predetermined dimensional length $L_2$ (FIG. 3), taken parallel to the longitudinal plane 50, that generally equals the length $L_1$ of the generally circular load transferring surface 52. A clearance relief surface 61 on the respective side surfaces 58 defines the respective clearance reliefs 60. Two opposed sides 58 of the generally rectangular load transferring pocket 56 are angled generally at two and four-tenths degrees with respect to the longitudinal plane 50 and the other two opposed sides 58 are angled at generally eighty seven and six-tenths degrees therewith.

Figure 6:
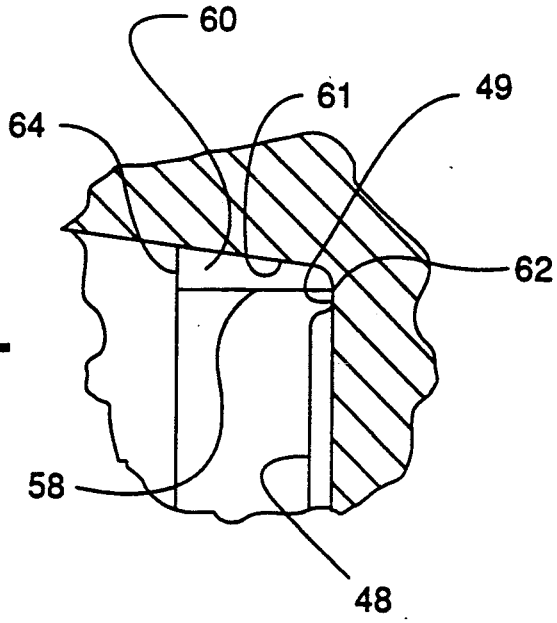
FIG. 6 is a partial view 6—6 taken from the cross-sectional view of FIG. 5.

Referring more specifically to FIGS. 5 and 6, the clearance reliefs 60 are generally identically formed and only one of the clearance reliefs will be explained in more detail. Each of the clearance reliefs 60 has a bottom edge 62 which coincides with an edge of the respective side surface 58 at the bottom of the groove 49 in the socket 40. Each clearance relief 60 has a upper edge 64 that angles outwardly at an angle of approximately eight degrees from the respective respective side surfaces 58 starting at a point generally midway of the transverse length thereof as clearly shown in FIG. 5.

As more clearly shown in FIGS. 2 and 3, a relief cavity 68 is disposed on the rearward end portion 36 and located in the socket 40 between the generally rectangular load transferring pocket 56 and the generally circular load transferring surface 52. The relief cavity 68 has a dimensional length $L_3$ (FIG. 3), taken parallel to the longitudinal plane 50, that is longer than the length $L_1$ of the generally circular load transferring surface 52 or the length $L_2$ of the generally rectangular load transferring pocket 56. As illustrated herein, the length $L_3$ of the relief cavity 68 is generally two to three times longer than the length $L_1$ of the generally circular load transferring surface 52 or the length $L_2$ of the generally rectangular load transferring pocket 56.

It is recognized that the clearance reliefs 60 could be of various shapes and/or sizes without departing from the essence of the invention as long as they are free of load transferring contact with the four raised helical threads 26 of the adapter 14 when the tooth 12 is mounted thereon. Likewise, the clearance slots 54 could be of various sizes and configurations without departing from the essence of the invention.

INDUSTRIAL APPLICABILITY

In use, the tooth 12 is mounted straight onto the adapter 18 without requiring any rotational movement of the tip 12 during the assembly thereof. Likewise, the tip 12 is removed in a linear direction from the adapter 12 without requiring any rotation of the tip during the disassembly. The ability to assemble the tooth 12 straight onto the adapter 14 is provided by the four clearance slots 54, the relief cavity 68, and the four clearance reliefs 60 that are defined on the rear end portion 36 within the socket 40. Consequently, since there is no mating contact between the four raised helical threads 26 and any portion of the socket 40, no rotary motion of the tooth 12 is required during assembly. By having two of the sides of the generally rectangular load bearing pocket 56 angled at generally two and four-tenths degrees with respect to the longitudinal plane 50 and the other two sides thereof angled at eighty seven and six tenths degrees therewith, the subject tooth 12 fits, without the need to rotate during assembly, adapters already in use in the market place. During use, all loads applied to the forward end portion 34 are transferred to the adapter 18 through the side surfaces 58 of the generally rectangular load transferring pocket 56 and the generally circular load transferring surface 52. The U-shaped lock 16, when assembled as previously noted, secures the tooth 12 to the adapter 14 and further functions to inhibit, during use, any twisting movement of the tooth 12 on the adapter 18.

When it is necessary to remove the tooth 12 from the adapter 14, the U-shaped lock 16 is removed and the tip 12 is easily removed in a linear direction without having to twist the tooth 12 relative to the four raised helical threads. Even with fine dirt particles packed within the socket 40, it is still easier to remove the tooth 12 in a linear direction as opposed to having to move and rotate the tooth 12 at the same time.

In the view of the foregoing, it is readily apparent that the structure of the cavity 40 of the tooth 12 provides a simple arrangement that allows the tip 12 to be assembled and disassembled on the adapter 14 in a linear direction without requiring turning of the tooth 12.

Other aspects, objects, and advantages of this invention can be obtained from a study of the drawings, the disclosure, and the appended claims.

I claim:

1. A tooth adapted for connection to an adapter having a nose portion and four raised helical threads disposed on the nose portion in angularly spaced apart relation, each thread of the four raised helical threads extends from a forward end of the nose portion rearwardly to a rearward end thereof, the tooth comprising:

a forward end portion operative to engage the ground; and a rearward end portion operative to be releasably connected to the adapter, the rearward end portion defining a socket therein having an opening and a bottom, the socket being operative, when assembled, to receive the nose portion of the adapter, the rearward end portion having in general longitudinal alignment a generally rectangular load transferring pocket located in the socket adjacent the bottom thereof, a generally circular load transferring surface located in the socket adjacent the opening thereof, and a relief cavity defined circumferentially around the interior of the socket between the generally rectangular load transferring pocket and the generally circular load transferring surface, each side of the rectangular load transferring pocket has a clearance relief define thereon and the circular load transferring surface has four clearance slots defined thereon circumferentially spaced from one another, the clearance reliefs, the relief cavity, and the clearance slots are operative, when assembling the tooth on the adapter, to provide unobstructed clearance for the four raised helical threads on the adapter.

2. The tooth of claim 1 wherein a clearance relief surface defines each of the clearance reliefs on the generally rectangular load transferring pocket and when assembled, each of the clearance relief surfaces is adapted to be free of load bearing contact with the nose of the adapter.

3. The tooth of claim 2 wherein a clearance slot surface defines each of the clearance slots and when assembled, each of the clearance slot surfaces is free of load bearing contact with any portion of the nose of the adapter.

4. The tooth of claim 1 wherein the generally rectangular load transferring pocket has a predetermined dimensional length taken parallel to the longitudinal plane and the relief cavity has a predetermined dimensional length taken parallel to the longitudinal plane that is longer than the length of the generally rectangular load transferring pocket.

5. The tooth of claim 4 wherein the generally circular load transferring surface has a predetermined dimensional length taken parallel to the longitudinal plane that is generally equal to the length of the generally rectangular load transferring pocket.

6. The tooth of claim 5 wherein the length of the relief cavity is generally two to three times longer than the length of the generally rectangular load transferring pocket.

7. The tooth of claim 1 including locking tabs on the rearward end portion extending rearwardly from a location adjacent the opening of the socket and operative, when assembled in conjunction with a locking mechanism, to secure the tooth to the adapter.

8. A tooth adapted for connection, without angular rotation during assembly, to an adapter having a nose portion and four raised helical threads disposed thereon in angularly spaced apart relation, each thread of the four raised helical threads extends from a forward end of the nose portion rearwardly to a rearward end thereof, the tooth comprising:

a forward end portion operative to engage the ground; and a rearward end portion operative to be releasably connected to the adapter, the rearward end portion defining a socket having an opening and a bottom therein, the socket being operative, when assembled, to receive the nose portion of the adapter, the rearward end portion having in general longitudinal alignment a generally rectangular load transferring pocket located in the socket adjacent the bottom of the socket and a generally circular load transferring surface located in the socket adjacent the opening thereof, clearances are defined on the generally rectangular load transferring pocket and on the generally circular load transferring surface so that the tooth can be assembled straight onto the nose portion of the adapter free of angular rotation and free of contact with the four raised helical threads on the nose portion.

9. The tooth of claim 8 wherein the clearances on the generally rectangular load transferring pocket are adapted to provide unobstructed clearance for the four raised helical threads on the nose portion of the adapter when assembling the tooth straight onto the nose portion thereof.

10. The tooth of claim 9 wherein the clearances defined on the generally circular load transferring surface are adapted to provide unobstructed clearance for the four raised helical threads on the nose portion of the adapter when assembling the tooth straight onto the nose portion thereof.

11. The tooth of claim 10 including a relief cavity defined circumferentially around the interior of the socket between the generally rectangular load transferring pocket and the generally circular load transferring surface.

12. The tooth of claim 11 wherein the relief cavity is adapted when assembling the tooth straight onto the nose portion to provide unobstructed clearance for the four raised helical threads on the nose portion of the adapter.

* * * * *